US010231541B2

(12) United States Patent
Gasser

(10) Patent No.: US 10,231,541 B2
(45) Date of Patent: Mar. 19, 2019

(54) RAIL SYSTEM FOR A DRAWER

(71) Applicant: Julius Blum GmbH, Hochst (AT)

(72) Inventor: Ingo Gasser, Hochst (AT)

(73) Assignee: Julius Blum GmbH, Hoechst (AT)

( * ) Notice: Subject to any disclaimer, the term of this patent is extended or adjusted under 35 U.S.C. 154(b) by 476 days.

(21) Appl. No.: 14/063,327

(22) Filed: Oct. 25, 2013

(65) Prior Publication Data

US 2014/0049148 A1 Feb. 20, 2014

Related U.S. Application Data

(63) Continuation of application No. PCT/AT2012/000045, filed on Feb. 29, 2012.

(30) Foreign Application Priority Data

Apr. 27, 2011 (AT) ..... 587/2011

(51) Int. Cl.
*A47B 88/40* (2017.01)
*A47B 88/90* (2017.01)
*A47B 88/427* (2017.01)

(52) U.S. Cl.
CPC ..... *A47B 88/941* (2017.01); *A47B 88/40* (2017.01); *A47B 88/427* (2017.01); *A47B 2088/902* (2017.01); *A47B 2210/02* (2013.01)

(58) Field of Classification Search
CPC . A47B 88/04; A47B 88/0422; A47B 88/0014; A47B 88/0055; A47B 2210/02; A47B 2210/01; A47B 2210/091; A47B 2230/0014; A47B 2088/0014; A47B 2088/0059; A47B 2088/0055; A47B 2088/902
(Continued)

(56) References Cited

U.S. PATENT DOCUMENTS 5,181,772 A * 1/1993 Albiez ..... 312/348.4
5,478,146 A * 12/1995 Grabher ..... 312/348.1
(Continued)

FOREIGN PATENT DOCUMENTS

AT 006 773 4/2004
AU 2007293953 3/2008
(Continued)

OTHER PUBLICATIONS

International Search Report (ISR) dated Jul. 2, 2012 in International (PCT) Application No. PCT/AT2012/000045.
(Continued)

*Primary Examiner* — Daniel J Troy
*Assistant Examiner* — Ryan A Doyle
(74) *Attorney, Agent, or Firm* — Wenderoth, Lind & Ponack, L.L.P.

(57) ABSTRACT

A drawer side wall having an inner wall and an outer wall which can be connected to the inner wall. A container rail is provided, and the drawer side wall can be connected to the container rail. An upwardly protruding front projection with a device for attachment of a drawer front panel is arranged on the container rail, and the inner wall is directly firmly connected to the container rail in a lower region. The front projection is directly firmly connected, preferably by welding, to the inner wall in an upper region of the inner wall.

16 Claims, 11 Drawing Sheets

(58) Field of Classification Search
USPC ..... 312/348.4, 348.1, 348.2, 330.1, 334.8
See application file for complete search history.

(56) References Cited

U.S. PATENT DOCUMENTS

| | | | | | |
|---|---|---|---|---|---|
| 5,536,083 | A * | 7/1996 | Brustle et al. | 312/334.6 | |
| 5,540,515 | A * | 7/1996 | Rock et al. | 403/322.4 | |
| 5,556,183 | A * | 9/1996 | Brustle | A47B 88/0422 | 312/330.1 |
| 5,564,807 | A * | 10/1996 | Rock et al. | 312/331 | |
| 5,588,730 | A * | 12/1996 | Rock | A47B 88/0014 | 312/263 |
| 5,709,444 | A * | 1/1998 | Fitz et al. | 312/348.2 | |
| 5,860,718 | A * | 1/1999 | Brustle | 312/348.2 | |
| 5,971,516 | A * | 10/1999 | Huber | 312/348.1 | |
| 6,053,592 | A * | 4/2000 | Sutterlutti | A47B 88/0014 | 312/330.1 |
| 6,412,893 | B1 * | 7/2002 | Muterthies | A47B 88/0014 | 312/330.1 |
| 6,474,761 | B1 * | 11/2002 | Muterthies et al. | 312/348.1 | |
| 6,481,813 | B1 * | 11/2002 | Muterthies et al. | 312/348.1 | |
| 6,485,121 | B1 * | 11/2002 | Muterthies et al. | 312/348.1 | |
| 6,981,752 | B2 * | 1/2006 | Harn et al. | 312/348.4 | |
| 8,491,069 | B2 * | 7/2013 | Haemmerle | A47B 88/12 | 312/333 |
| 8,727,461 | B2 * | 5/2014 | Holzapfel et al. | 312/348.4 | |
| 2005/0162053 | A1 | 7/2005 | Larsen, Jr. | | |
| 2009/0039746 | A1 | 2/2009 | Lam et al. | | |
| 2009/0309471 | A1 | 12/2009 | Yu et al. | | |

FOREIGN PATENT DOCUMENTS

| | | | | |
|---|---|---|---|---|
| CN | 2590454 | | 12/2003 | |
| CN | 201153737 | | 11/2008 | |
| CN | 101606789 | | 12/2009 | |
| DE | 20 2005 018 788 | | 4/2007 | |
| DE | 20 2007 001 780 | | 1/2008 | |
| EP | 1 084 655 | | 3/2001 | |
| EP | 1 157 636 | | 11/2001 | |
| EP | 2 022 371 | | 2/2009 | |
| JP | 7-213359 | | 8/1995 | |
| JP | 3031495 | | 9/1996 | |
| TW | 200836667 | | 9/2008 | |
| WO | 2007/062961 | | 6/2007 | |
| WO | WO 2007137311 | A2 * | 12/2007 | A47B 88/0055 |
| WO | WO 2009006651 | A2 * | 1/2009 | A47B 88/0055 |

OTHER PUBLICATIONS

Austrian Patent Office Search Report (ASR) dated Nov. 24, 2011 in Austrian Patent Application No. A 587/2011.
Chinese Search Report (SR) dated Dec. 17, 2014 in foreign counterpart Chinese Patent Application No. 201280020606.0.

* cited by examiner

RAIL SYSTEM FOR A DRAWER

BACKGROUND OF THE INVENTION

The invention concerns a drawer side wall having an inner wall and an outer wall connectable to the inner wall, and the drawer side wall is connectable to a container rail. Arranged on the container rail is an upwardly projecting front fitment member with a device for fixing a drawer front panel.

Drawer side walls are frequently arranged on or fixed to container rails. Two container rails are then typically inserted into suitable openings in the underside of the bottom of a drawer and serve to connect the drawer to moveable extension rails of two drawer extension guides arranged on a furniture carcass. In the case of container rails known in the state of the art, a front fitment member and a rear fitment member are frequently respectively arranged thereon, the fitment members serving to fix a drawer front panel and drawer rear wall respectively (for example EP 1 084 655 A1, EP 1 157 636 A1). Forces which are usually applied to that arrangement by way of the drawer front panel, for example by pushing against the drawer for closing it, are in that case carried primarily by the fixing points or fixing regions of the front fitment member to the container rail. Particularly in the case of high drawer front panels or high front fitment members, that leads to a lack of stability.

SUMMARY OF THE INVENTION

Therefore the object of the invention is to provide a drawer side wall which is improved over the state of the art. In particular, the invention seeks to achieve a higher level of stability in the event of a force acting by way of the drawer front panel.

According to the invention, in a lower region the inner wall is directly fixedly connected to the container rail, and in an upper region of the inner wall the front fitment member is directly fixedly connected to the inner wall, preferably by welding.

That affords increased stability, in particular in the event of a force acting by way of a drawer front panel mounted to the front fitment member. Additional fixing of the front fitment member to the inner wall of a drawer side wall in an upper region of the inner wall provides that applied forces no longer have to be carried only primarily by way of the fixing points or fixing regions of the front fitment member to the container rail. The forces can also be carried by way of the fixing points or regions of the front fitment member to the drawer side wall. As a result, applied forces can not only be better distributed to the drawer but there is also an overall more stable structure. In addition, as a result, fixing of the front fitment member to the container rail can be simpler and thus less expensive. Connecting the front fitment member to the inner wall of a drawer side wall can be effected in that case for example by welding, riveting, screwing, clinching or wobble clinching.

In a particularly preferred embodiment, arranged on the container rail is an upwardly projecting rear fitment member with a device for fixing a drawer rear wall. In an upper region of the inner wall, the rear fitment member can be directly fixedly connected to the inner wall, preferably by welding, riveting, screwing, clinching or wobble clinching.

In that respect, it has proven to be particularly advantageous if the front fitment member and/or the rear fitment member are directly fixedly connected to the container rail, preferably by welding, riveting, screwing, clinching or wobble clinching. That gives a stable frame formed from the container rail, the fitment members (front fitment member and rear fitment member) arranged on the container rail and the inner wall to which the front fitment member and the rear fitment member can be directly and fixedly connected. In a lower region, the inner wall is also directly fixedly connected to the container rail, for example by clinching, riveting, screwing or welding. The stable frame provides that forces which are applied to that arrangement for example by way of the drawer front panel or by way of the drawer rear wall can be very well absorbed. Because the front fitment member and the rear fitment member can be fixed to the inner wall of a drawer side wall, the outer wall of the drawer side wall is particularly unaffected by the action of forces of the above-described kind. In that way, an outer wall can also be in the form of a pure cladding element and can comprise materials which would not withstand the action of such forces.

A particularly advantageous embodiment of the invention is that in which the inner wall at least partially comprises steel. If, in addition, the container rail and/or the front fitment member and/or the rear fitment member at least partially comprise or comprises steel, a connection of the front fitment member and/or rear fitment member to the inner wall and the container rail can be effected in a particularly simple and inexpensive fashion by welding.

To protect from corrosion, the front fitment member and/or the rear fitment member can at least partially comprise galvanized steel sheet. The inner wall and/or the outer wall of the drawer side wall can, for example, also at least partially comprise aluminum and/or a coated steel (for example with a plastic coating) and/or a stainless steel.

BRIEF DESCRIPTION OF THE DRAWINGS

Further details and advantages of the present invention are described by means of the specific description hereinafter with respect to the drawings, in which.

DETAILED DESCRIPTION OF THE INVENTION

Figure 1:
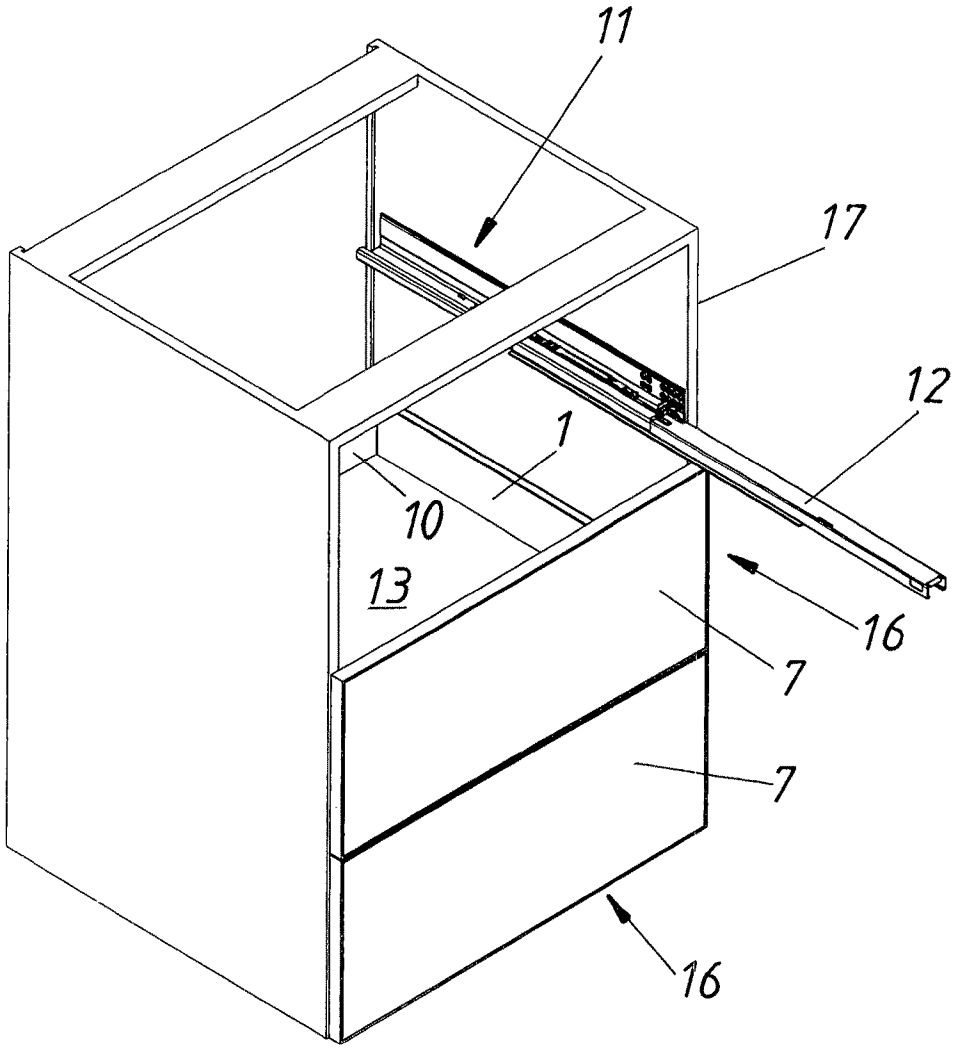
FIG. 1 is a perspective view of an article of furniture with drawers which are mounted displaceably relative to a furniture carcass by way of drawer extension guides.

FIG. 1 is a perspective view of an article of furniture, in which drawers 16 are mounted displaceably relative to a furniture carcass 17 by drawer extension guides 11. A drawer 16 respectively includes two drawer side walls 1, a drawer rear wall 10, a drawer front panel 7 and a bottom 13. The bottom 13 of a drawer 16 typically has at the underside two openings for receiving a container rail 4 (not shown here), with which the drawer 16 is to be connected to the extension rails 12 of two drawer extension guides 11 fixed to the furniture carcass 17 at left and right.

Figure 2:
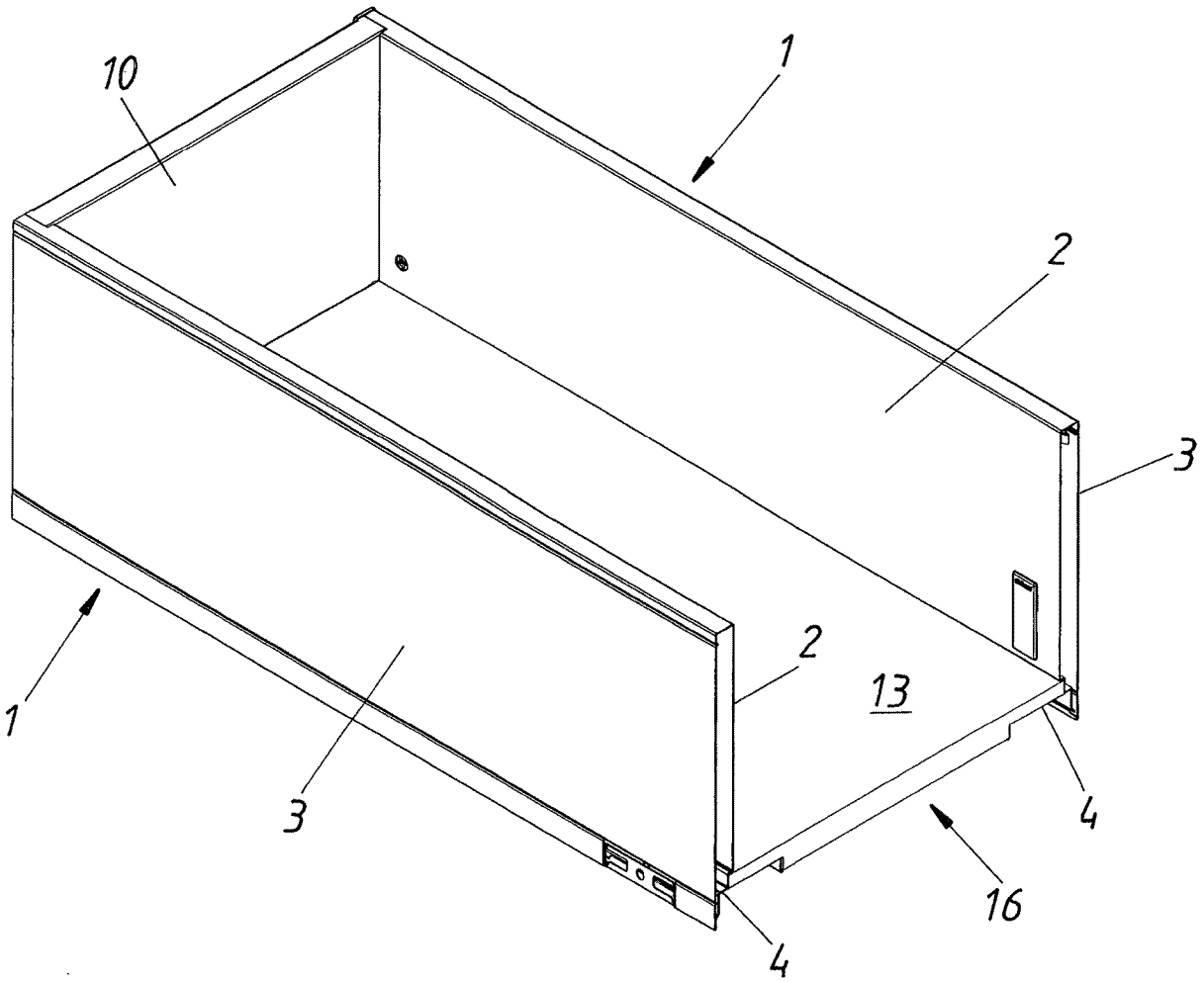
FIG. 2 is a perspective view of a drawer without drawer front panel.

FIG. 2 shows a perspective view of a drawer 16 with drawer front panel 7 removed. The side walls 1 of the drawer 16 respectively include an inner wall 2 and an outer wall 3 connected to the respective inner wall 2. At the underside, the bottom 13 of the drawer 16 has two openings which are substantially positively lockingly clad by two container rails 4. The container rails 4 serve for fixing the drawer 16 to the extension rails 12 of the drawer extension guide 11 (see FIG. 1).

Figure 3:
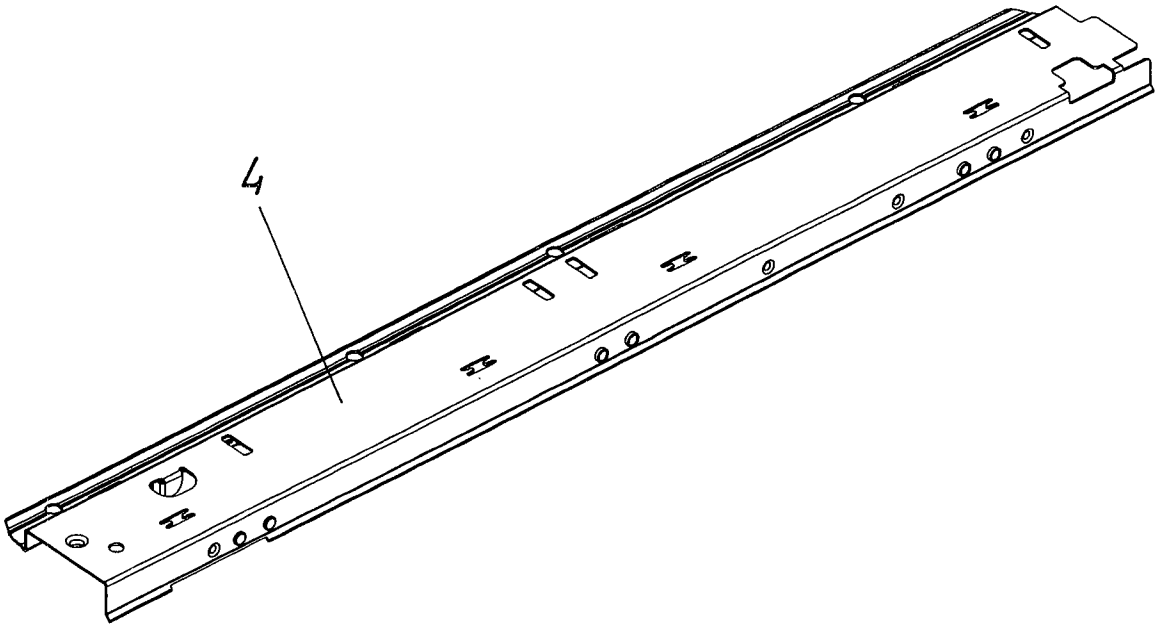
FIG. 3 is a perspective view of a container rail.

FIG. 3 shows by way of example such a container rail 4. The container rail 4 has a substantially Z-shaped or S-shaped cross-sectional configuration so that a drawer 16 with container rails 4 mounted thereto can be comfortably fitted on to the extension rails 12 of drawer extension guides 11 and can be fixed thereon.

Figure 4:
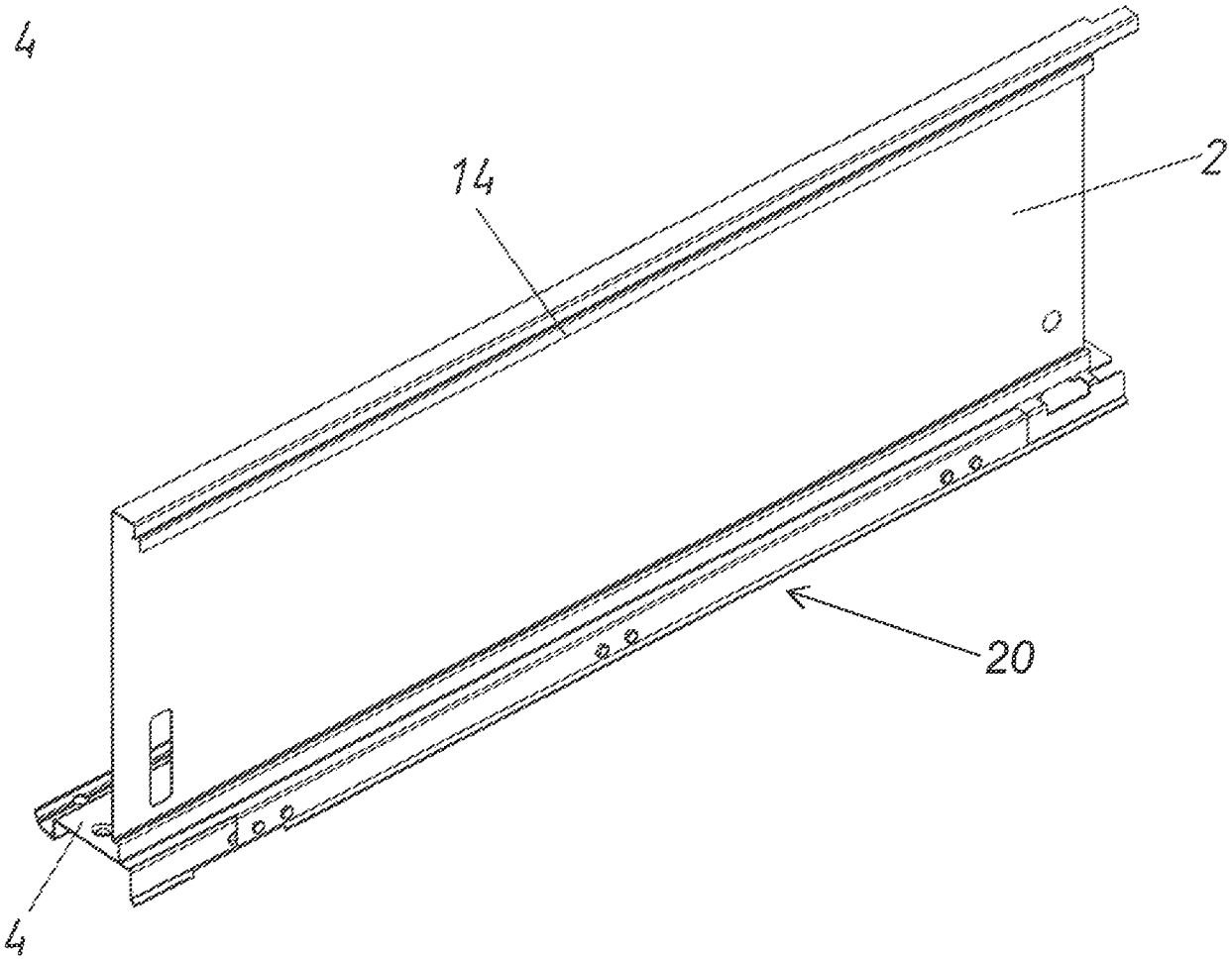
FIG. 4 shows the container rail of FIG. 3 with inner wall arranged thereon of a drawer side wall.

FIG. 4 shows the container rail 4 of FIG. 3, the inner wall 2 of a drawer side wall 1 being arranged on the container rail 4. In this example, the inner wall 2 is connected directly and fixedly in a lower region 20 of the inner wall 2 to a substantially vertically downwardly pointing limb of the container rail 4, and the inner wall 2 is bent over along the outer longitudinal edge of the container rail 4. That connection can be made, for example, by clinching, welding, riveting or screwing. In this example, in the region of its upper outer longitudinal edge, the inner wall 2 has a portion which is bent in a substantially S-shaped cross-section and which serves as a receiving means for making a positively locking connection to the outer wall 3 (see FIGS. 9 and 10). Adjoining that S-shaped portion is a substantially vertically downwardly pointing fixing limb 14, to which a front fitment member 5 and a rear fitment member 8 can be fixed as a further succession. In this example, the fixing limb 14 extends along the entire longitudinal extent of the inner wall 2. It will be appreciated, however, that the fixing limb 14 may also extend only portion-wise along the longitudinal extent of the inner wall 2.

Figure 5:
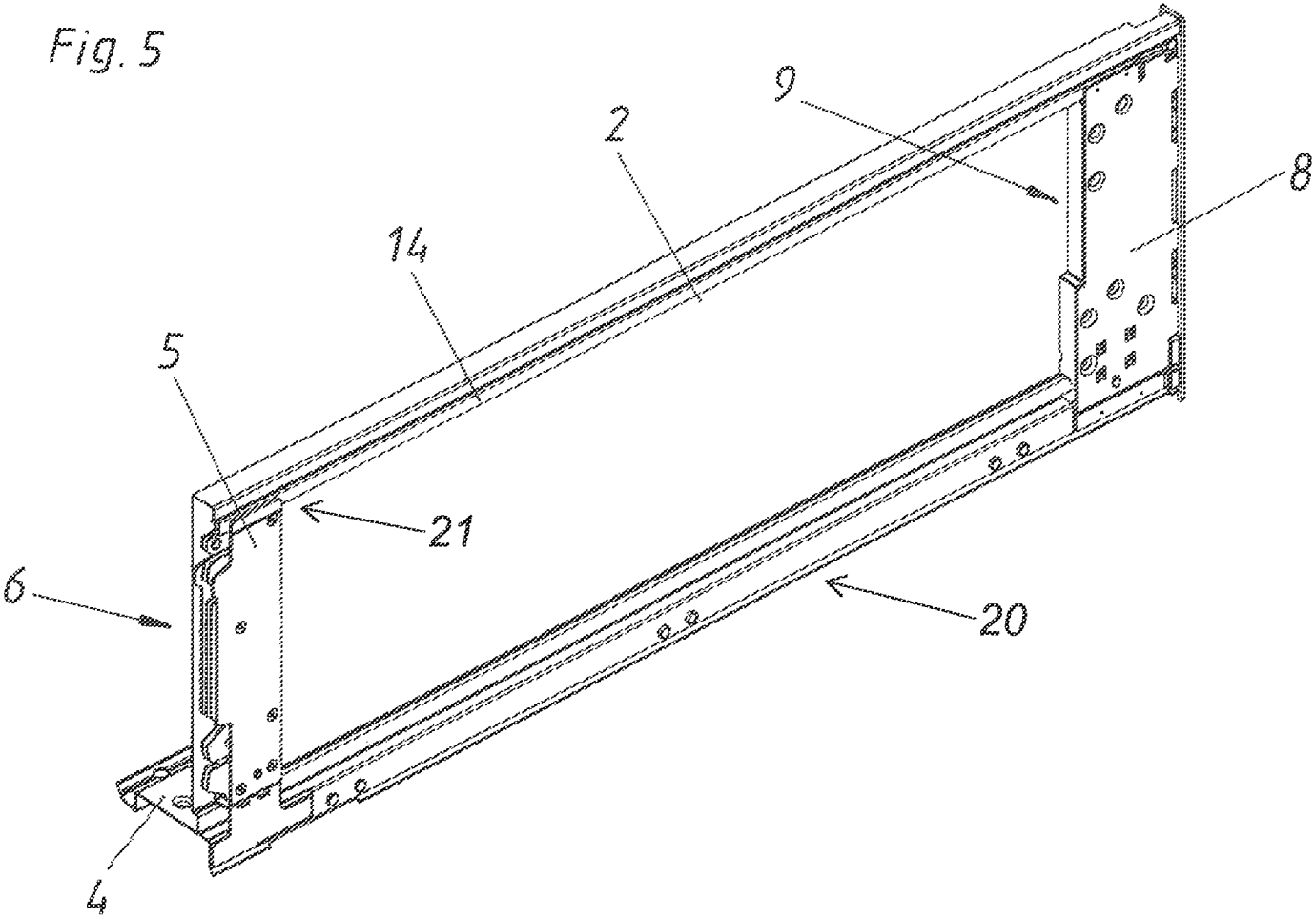
FIG. 5 shows a front fitment member and a rear fitment member arranged on the container rail and the inner wall.

FIG. 5 shows the arrangement of FIG. 4, wherein the front fitment member 5 and a rear fitment member 8 are respectively directly and fixedly connected to the vertically downwardly pointing limb of the container rail 4 and to the fixing limb 14 of the inner wall 2. That connection can be made, for example, by welding, riveting, screwing, clinching or wobble clinching. An attachment device 6 for fixing a drawer front panel 7 (not shown here) is arranged on the front fitment member 5, and an attachment device 9 for fixing a drawer rear wall 10 (also not shown here) is arranged on the rear fitment member 8 (see FIG. 1).

Figure 6:
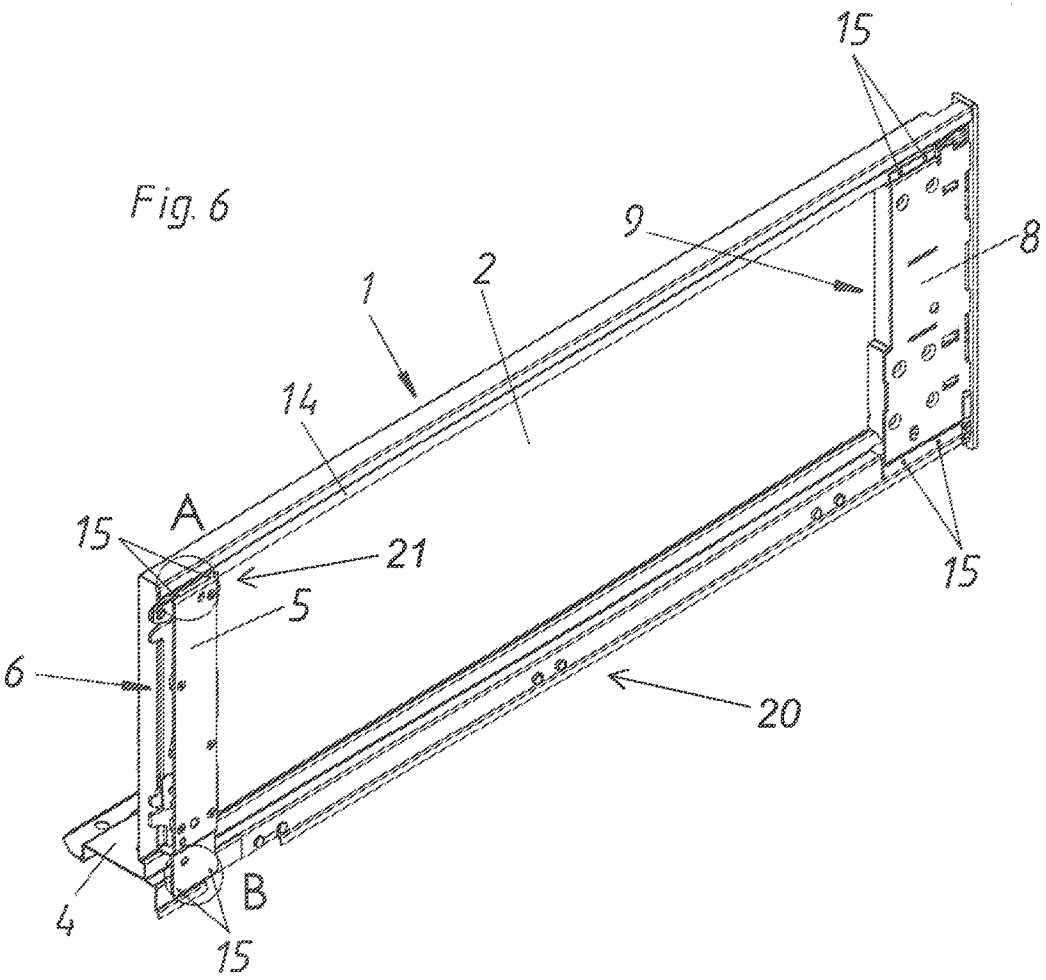
FIG. 6 shows a further example of a front fitment member and a rear fitment member arranged on the container rail and the inner wall.

FIG. 6 shows a perspective view of a container rail 4, an inner wall 2 connected to the container rail 4, and a front fitment member 5 and a rear fitment member 8 each respectively connected to the container rail 4 and the inner wall 2. The container rail 4, the inner wall 2, the front fitment member 5 and the rear fitment member 8 in this example at least partially comprise steel. As a result, front fitment member 5 and rear fitment member 8 can be welded easily and inexpensively at the fixing points 15 to the container rail 4 and to the fixing limb 14 of the inner wall 2.

Figure 7A:
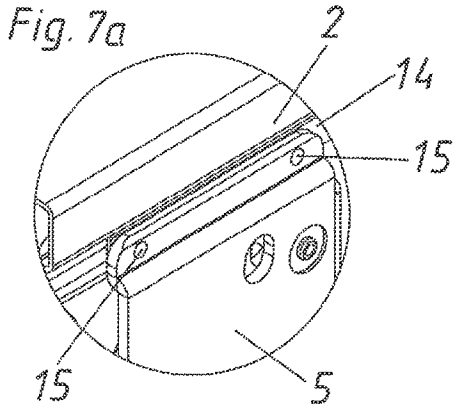
FIGS. 7*a* and 7*b* are detail views of FIG. 6.
Figure 7B:
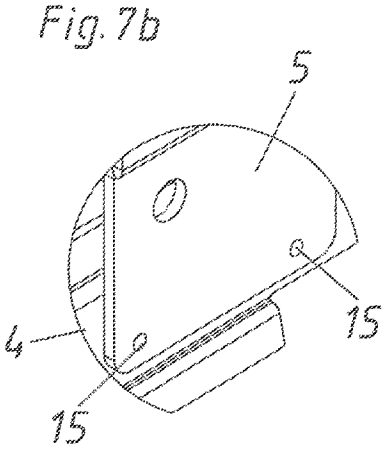

FIG. 7*a* shows an enlarged view of the region marked by A in FIG. 6, while FIG. 7*b* shows an enlarged view of the region marked B in FIG. 6. In this case, it is possible to see, in particular, the fixing points 15 at which the front fitment member 5 is welded to the fixing limb 14 of the inner wall 2 and to the container rail 4.

Figure 8:
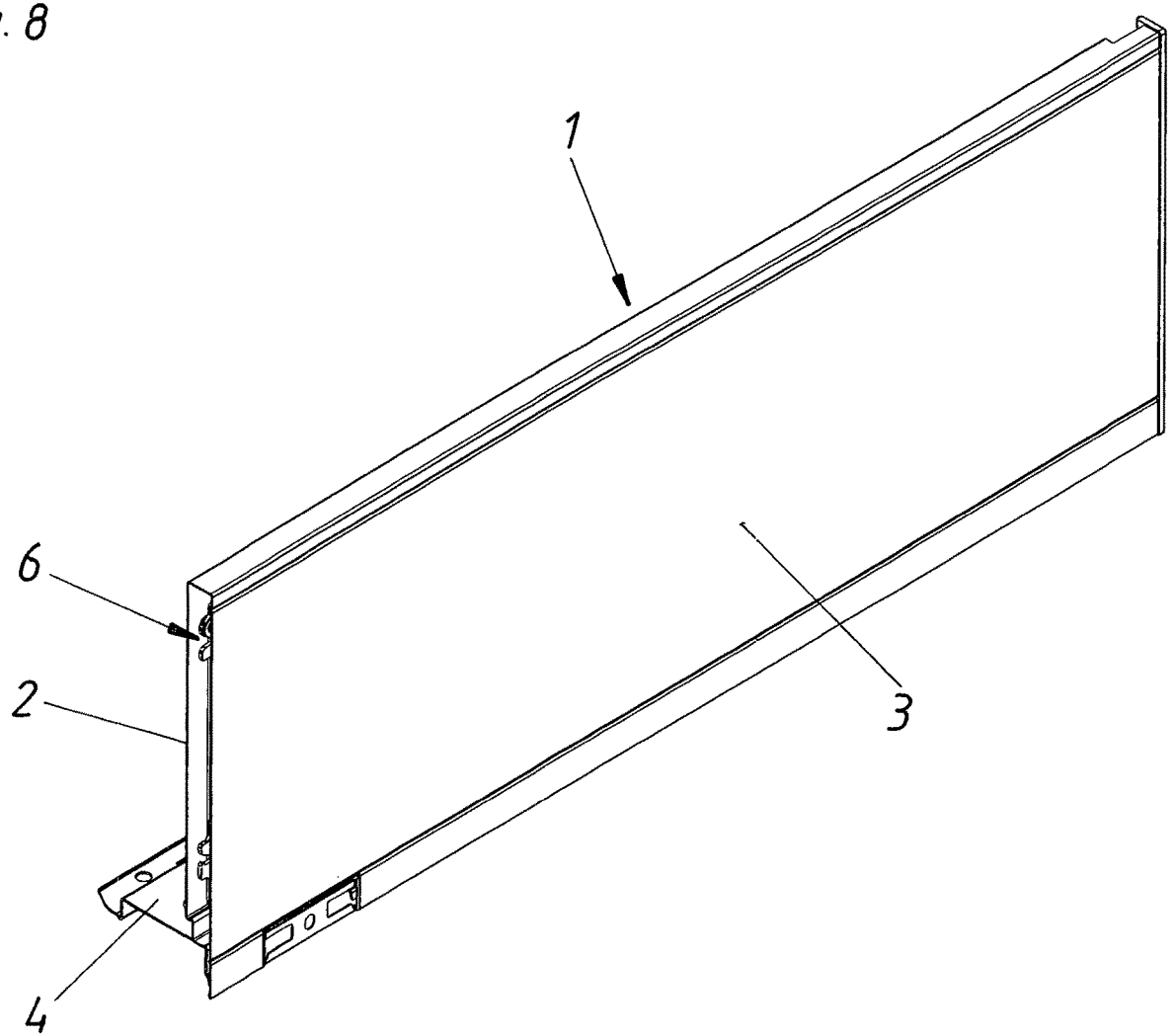
FIG. 8 is a perspective view of a proposed drawer side wall arranged on a container rail.

FIG. 8 shows a perspective view of an arrangement comparable to FIG. 6, wherein an outer wall 3 of the drawer side wall 1 is connected to that arrangement. In this example, the outer wall 3 is clipped into suitably shaped portions of the inner wall 2 and the container rail 4 (see FIG. 10).

Figure 9:
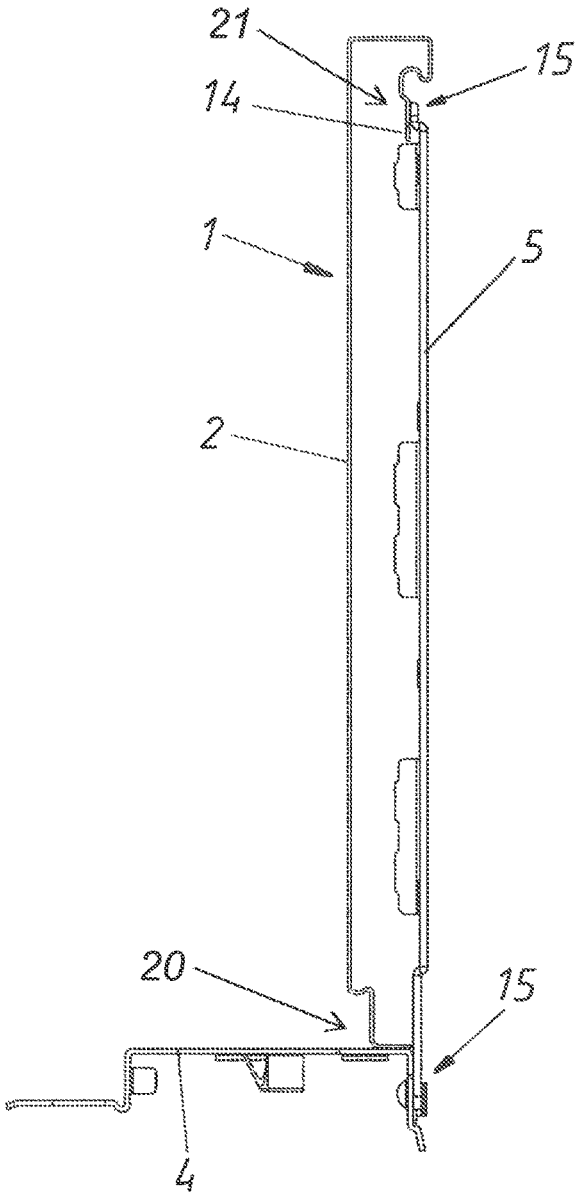
FIG. 9 is a front view of the drawer side wall of FIG. 8 without outer wall.

FIG. 9 shows a front view of the arrangement of FIG. 8 with the outer wall 3 removed. The inner wall 2 has a wall portion which extends substantially vertically and flat and is connected in its lower region 20 to a top wall of the container rail 4, for example by clinching or welding. In its upper region 21 in this example, the inner wall 2 has in the region of its upper outer longitudinal edge a portion which is bent in a substantially S-shaped cross-section and which serves as a receiving means for a positively locking connection to an outer wall 3 (see FIG. 10). Adjoining that S-shaped portion is a substantially vertically downwardly pointing fixing limb 14 to which a front fitment member 5 is welded at the fixing points 15. The lower end region of the front fitment member 5 is also welded to the container rail 4 at the fixing points 15 (see FIG. 6).

Figure 10:
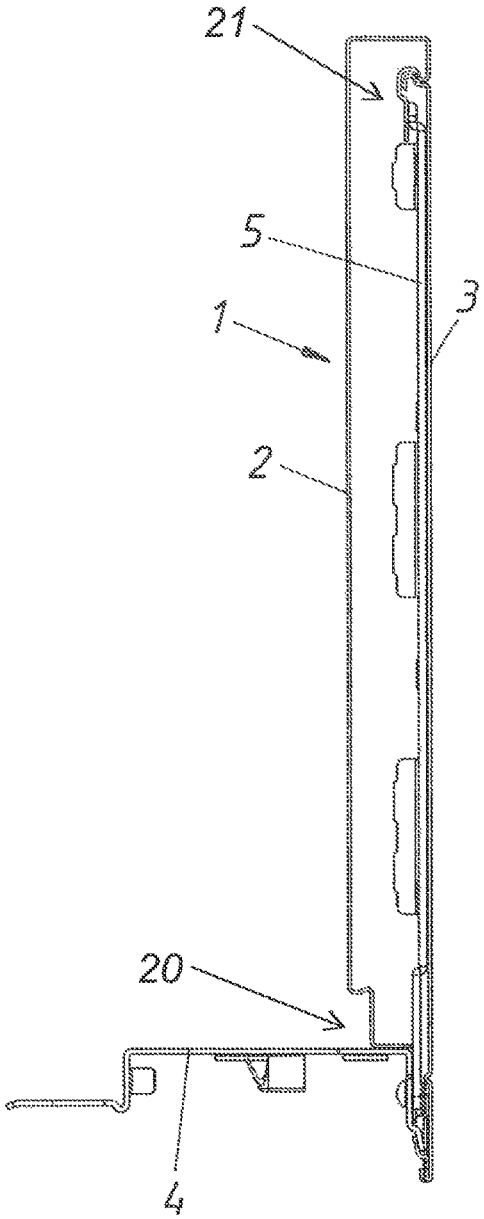
FIG. 10 shows the arrangement of FIG. 9 with outer wall arranged thereon.
Figure 11:
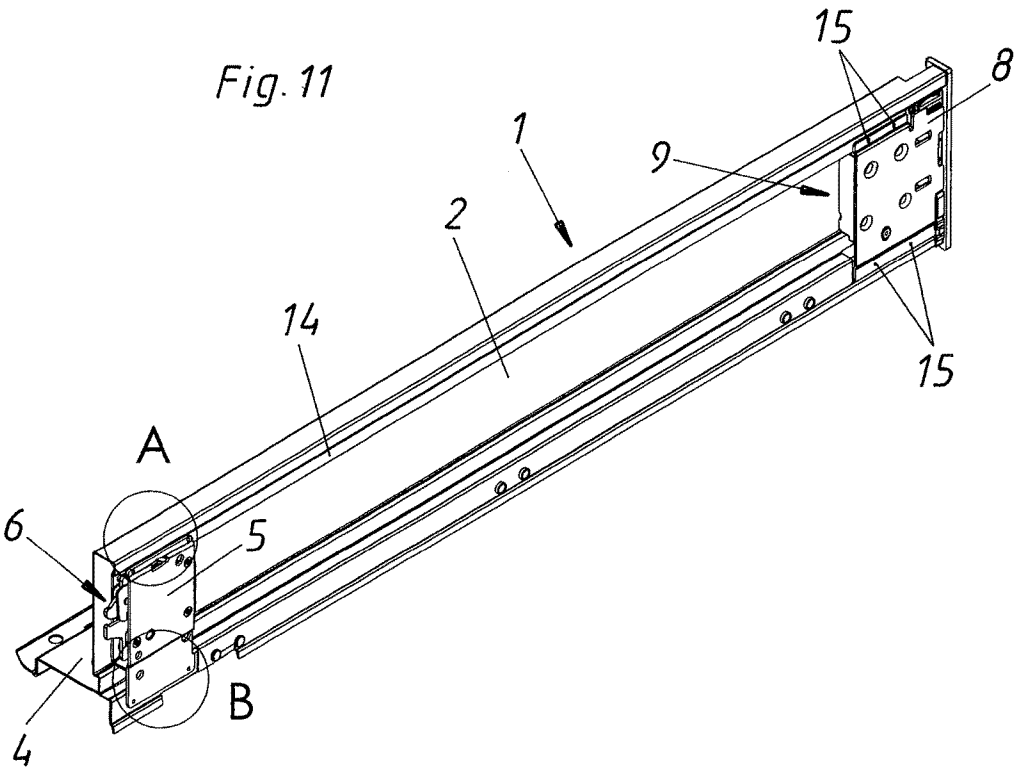
FIG. 11 is a perspective view of a proposed drawer side wall as shown in FIG. 6 of smaller height.
Figure 12A:
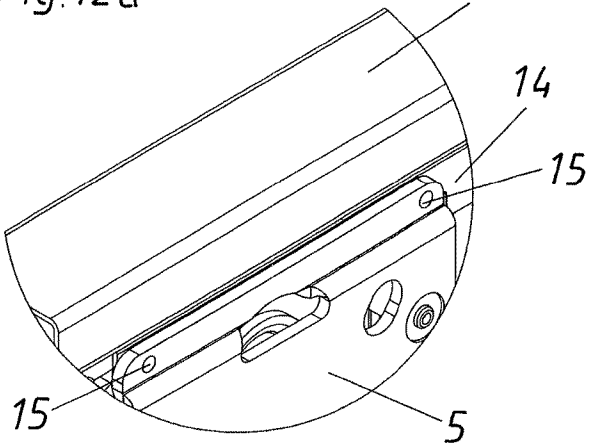
FIGS. 12*a* and 12*b* are detail views of FIG. 11.
Figure 12B:
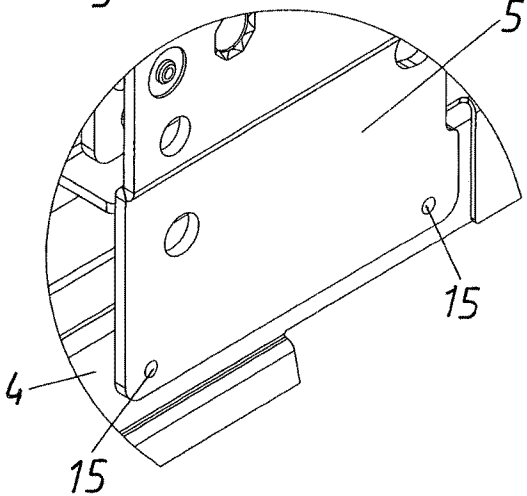
Figure 13:
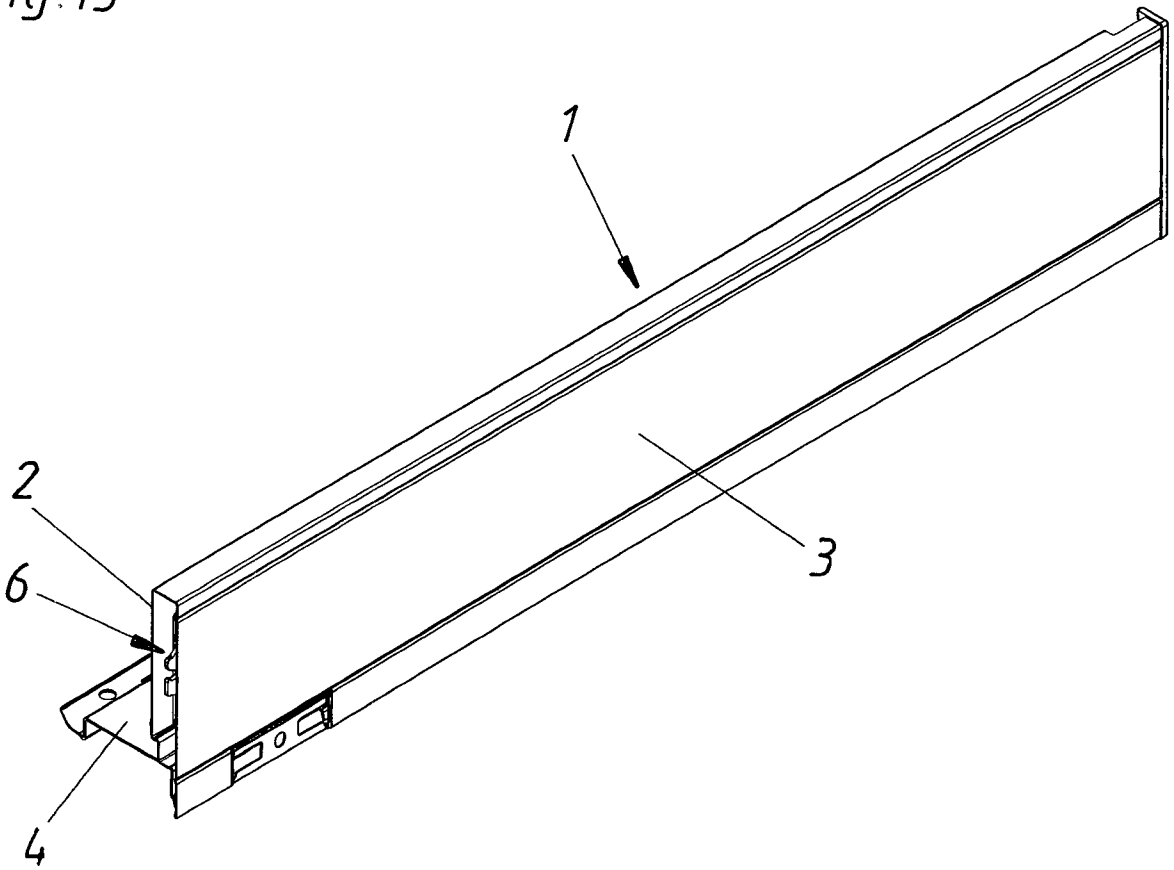
FIG. 13 is a perspective view of a proposed drawer side wall arranged on a container rail, of smaller height.
Figure 15:
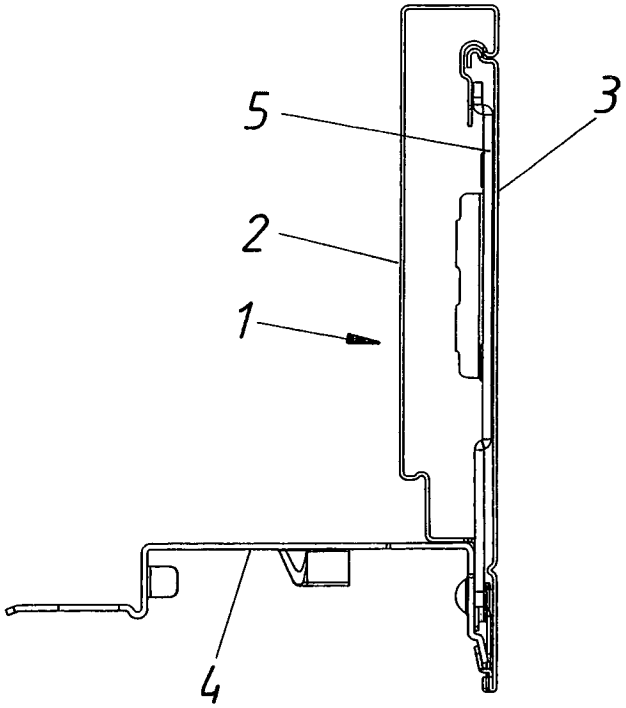
FIG. 15 shows the arrangement of FIG. 14 with outer wall arranged thereon.
Figure 14:
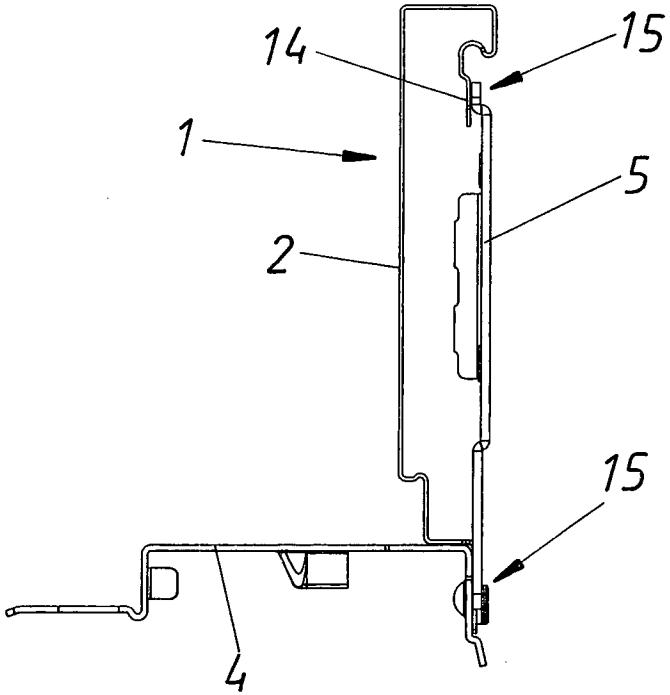
FIG. 14 is a front view of the drawer side wall of FIG. 13 without outer wall.

FIG. 10 shows the arrangement of FIG. 9 with the outer wall 3 arranged thereon. The upper end region of the outer wall 3 has a configuration which is hook-shaped in cross-section and which corresponds to the S-shaped portion in the upper region 21 of the inner wall 2 so that the outer wall 3 can be easily clipped into the S-shaped portion so that this gives a positively locking connection between the inner wall 2 and the outer wall 3. The lower end region of the outer wall 3 is folded over in this example so that, for fixing the outer wall 3 to a side wall of the container rail 4, a connection which is also positively locking can be made to a corresponding, inclinedly downwardly extending portion of the outer vertical limb of the container rail 4. Based on the above description and FIGS. 1-10, it is clear that the fitment members 5, 8 are discrete (distinct) from the container rail 4 such that the fitment members 5, 8 and the container rail 4 are not formed to have a one-piece construction.

FIGS. 11 through 15 show further examples of proposed drawer side walls 1 corresponding to FIGS. 6 through 10, wherein the drawer side walls 1 in FIGS. 11 through 15 have a lower structural height in comparison with the drawer side walls 1 shown in FIGS. 6 through 10.

The invention claimed is:

1. A drawer comprising:

a pair of drawer side walls including a first drawer side wall and a second drawer side wall; and a bottom between said first drawer side wall and said second drawer side wall;

wherein each of said pair of drawer side walls includes:

an inner wall arranged such that said inner wall of said first drawer side wall faces said inner wall of said second drawer side wall;

an outer wall connected to said inner wall;

a container rail to be fastened to an extension rail of a drawer extension guide, a lower region of said inner wall being directly fixed to said container rail, said container rail being at least as long as a respective one of said pair of drawer side walls such that said container rail extends along an entire length of said respective one of said pair of drawer side walls, said container rail being arranged below an upper edge of said bottom; and a discrete upwardly-projecting front fitment member having a lower region directly fixed to said container rail, said front fitment member including an attachment device for attaching a drawer front panel to said drawer side wall, an upper region of said inner wall being directly fixed to an upper region of said front fitment member.

2. The drawer of claim 1, wherein said lower region of said inner wall is welded directly to said container rail, said lower region of said front fitment member is welded directly to said container rail, and said upper region of said inner wall is welded directly to said upper region of said front fitment member.

3. The drawer of claim 1, wherein said lower region of said inner wall is clinched, riveted, screwed or welded to said container rail.

4. The drawer of claim 1, further comprising an upwardly projecting rear fitment member on said container rail, said rear fitment member including a device for fixing a drawer rear wall to said drawer side wall, said upper region of said inner wall being directly fixed to an upper region of said rear fitment member.

5. The drawer of claim 4, wherein said upper region of said inner wall is welded directly to said upper region of said rear fitment member.

6. The drawer of claim 4, wherein at least one of said front fitment member and said rear fitment member is directly welded, riveted, screwed, clinched, or wobble clinched to said container rail.

7. The drawer of claim 1, wherein said inner wall at least partially comprises steel.

8. The drawer of claim 1, wherein at least one of said container rail, said front fitment member, and said rear fitment member at least partially comprises steel.

9. The drawer of claim 1, wherein said outer wall is a discrete member formed separately from said inner wall.

10. The drawer of claim 1, wherein said container rail is configured such that an entirety of said container rail is located below a plane of an upper surface of said bottom.

11. The drawer of claim 1, wherein said container rail has a U-shaped cross-section portion for receiving the extension rail therein.

12. The drawer of claim 11, wherein said U-shaped cross-section portion is located below said upper edge of said bottom.

13. The drawer of claim 11, wherein said U-shaped cross-section portion is wider than said respective one of said pair of drawer side walls.

14. The drawer of claim 1, wherein a lower surface of said bottom has a recess, said container rail being fitted within said recess.

15. The drawer of claim 14, wherein said recess has an opening at a lateral side of said bottom.

16. The drawer of claim 1, wherein each of said pair of drawer side walls is configured such that said outer wall contacts a side wall of said container rail, and said inner wall contacts a top wall of said container rail.

* * * * *